US006588397B1

(12) United States Patent
Sieber

(10) Patent No.: US 6,588,397 B1
(45) Date of Patent: Jul. 8, 2003

(54) METHOD FOR STARTING AN INTERNAL COMBUSTION ENGINE, IN PARTICULAR ON A MOTOR VEHICLE

(75) Inventor: Udo Sieber, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/889,668

(22) PCT Filed: Oct. 18, 2000

(86) PCT No.: PCT/DE00/03653

§ 371 (c)(1),
(2), (4) Date: Jul. 19, 2001

(87) PCT Pub. No.: WO01/38726

PCT Pub. Date: May 31, 2001

(30) Foreign Application Priority Data

Nov. 20, 1999 (DE) ..... 199 55 857

(51) Int. Cl.[7] ..... F02B 17/00

(52) U.S. Cl. ..... 123/295; 123/305; 123/491; 123/179.5

(58) Field of Search ..... 123/295, 305, 123/430, 491, 179.5

(56) References Cited

U.S. PATENT DOCUMENTS 5,924,395 A * 7/1999 Moriya et al. ..... 123/90.15
6,446,596 B1 * 9/2002 Moser et al. ..... 123/295
6,453,864 B1 * 9/2002 Downs et al. ..... 123/179.3
6,467,451 B1 * 10/2002 Volz et al. ..... 123/295
6,474,293 B1 * 11/2002 Bauer et al. ..... 123/295

FOREIGN PATENT DOCUMENTS

DE 197 43 492 4/1999
EP 0 569 347 11/1993

* cited by examiner

*Primary Examiner*—John Kwon
(74) *Attorney, Agent, or Firm*—Walter Ottesen

(57) ABSTRACT

An internal combustion engine, especially an engine for a motor vehicle, is described which is provided with a piston, which is movable in a cylinder and acts on a crankshaft. The piston can run through an intake phase, a compression phase, a work phase and a discharge phase. A control apparatus is provided with which the fuel can be injected directly into a combustion chamber delimited by the cylinder and the piston in a first operating mode during a compression phase or in a second operating mode during an intake phase. The control apparatus is so configured that, for starting the engine at standstill of the crankshaft, fuel can be injected into that cylinder (no. 1) whose piston is disposed in the compression phase and can be ignited (20, 21) so that the crankshaft moves rearwardly (22).

11 Claims, 3 Drawing Sheets

Intake Phase
Exhaust Phase
Work Phase
Compression Phase
Ignition
Injection
°KW
OT1
OT2
OT3
OT4
OT3
OT1
Cylinder 1
Cylinder 3
Cylinder 4
Cylinder 2
S
U
20
21
22
23
24
25
26
27
28

Cylinder 1
Cylinder 3
Cylinder 4
Cylinder 2
OT1
OT2
OT3
OT4
OT1
OT2
OT3
°KW
U
S
30
31
32
33
34
35
36
37
38
Injection
Ignition
Compression Phase
Work Phase
Exhaust Phase
Intake Phase

METHOD FOR STARTING AN INTERNAL COMBUSTION ENGINE, IN PARTICULAR ON A MOTOR VEHICLE

FIELD OF INVENTION

The invention relates to a method for starting an internal combustion engine, especially of a motor vehicle, wherein the engine has a piston movable in a cylinder with the piston acting on a crankshaft. The piston can run through an intake phase, a compression phase, a work phase and a discharge phase. In the method, the fuel can be injected directly into a combustion chamber in a first operating mode during a compression phase or in a second operating mode during an induction phase. The combustion chamber is delimited by the cylinder and the piston. Furthermore, the invention relates to a corresponding internal combustion engine as well as a corresponding control apparatus, especially for a motor vehicle.

BACKGROUND INVENTION

A method of this kind as well as an internal combustion engine of this kind and a control apparatus of this kind are all known from U.S. Pat. No. 6,050,232.

There, during starting, the first injection is undertaken into that cylinder whose piston is in the work phase. In this way, a forward movement is imparted to the crankshaft and the engine is started. Under unfavorable conditions, such as when there is an unfavorable crankshaft angle, it is, however, possible that at least a first start attempt of the engine is not successful.

SUMMARY OF THE INVENTION

It is an object of the invention to improve the known method for starting an internal combustion engine.

This object is achieved in a method or in an internal combustion engine or in a control apparatus of the kind mentioned above in accordance with the invention in that, at standstill of the crankshaft, fuel is injected into that cylinder whose piston is in the compression phase and ignited so that the crankshaft moves backwards.

Because of this backward movement of the crankshaft, it is possible to bring the engine into a defined start position. It is therefore no longer possible that a start attempt ends in failure because of an unfavorable crankshaft angle. In lieu thereof, and via the backward movement of the crankshaft, the crankshaft is brought into a defined angular position from where the engine can be started without a starter.

In a first embodiment, the injection and/or the ignition is carried out in such a manner that the piston does not move past its rearward lower dead center point but that the movement of the crankshaft reverses itself into a forward movement. Because of the rearward movement of the crankshaft, there is no movement out of the clock frequency of the engine which is present at standstill. However, the crankshaft is at a reversal point after the rearward movement and this reversal point is defined at the start of this stroke. In this way, the engine can be started in a defined manner.

For this purpose, fuel is injected into that cylinder whose piston is located at the reversal point in the work phase and ignited at or shortly after the reversal point. A first forward movement of the crankshaft is achieved in this way.

Thereafter, fuel is injected into that cylinder whose piston is located in the reversal point in the compression phase and ignited shortly ahead or at top dead center of this piston. This is that cylinder into which, at the start, the first injection has taken place which has generated the backward movement. This affords the advantage that uncombusted mixture from the first combustion is now completely combusted. The crankshaft is further accelerated in the forward direction by the renewed injection and ignition which is present.

In a second embodiment, the injection and/or the ignition is carried out in such a manner that the piston moves beyond its rearward lower dead center point but not beyond its rearward top dead center point which follows the lower dead center point; instead, there, the movement of the crankshaft reverses into a forward movement. In contrast to the first embodiment, the crankshaft moves by one stroke rearwards. Thereafter, the crankshaft again arrives in a defined reversal point from which the engine can be started in a defined manner. Furthermore, this affords the advantage that, for the next injection and ignition, a larger air mass is present in the cylinder than in the first embodiment. From this results a larger acceleration capacity.

In the second embodiment, the subsequent starting takes place in the same manner as in the first embodiment.

Furthermore, fuel is injected into that cylinder whose piston is at the reversal point in the induction phase and ignited in the subsequent compression phase. Thereafter, fuel is injected into the cylinders and ignited in the normal sequence.

Of special significance is the realization of the method of the invention in the form of a control element which is provided for a control apparatus of an internal combustion engine, especially of a motor vehicle. A program is stored on the control element which has the capability of being run on a computer apparatus, especially on a microprocessor and is suitable for carrying out the method of the invention. In this case, the invention is therefore realized by a program stored on the control element so that this control element, which is provided with the program, defines the invention in the same manner as the method for which the program is suitable for carrying out. As a control element, especially an electric storage medium can be used, for example, a flash memory or a read-only-memory.

Further features, application possibilities and advantages of the invention become apparent from the description of the embodiments of the invention which follow and which are shown in the drawing. All descriptions or all illustrated features form for themselves or in any desired combination the subject matter of the invention independently of their arrangement in the patent claims or their dependency as well as independently of their formulation or illustration in the description and/or in the drawing.

DESCRIPTION OF THE PREFERRED EMBODIMENTS OF THE INVENTION

Figure 1:
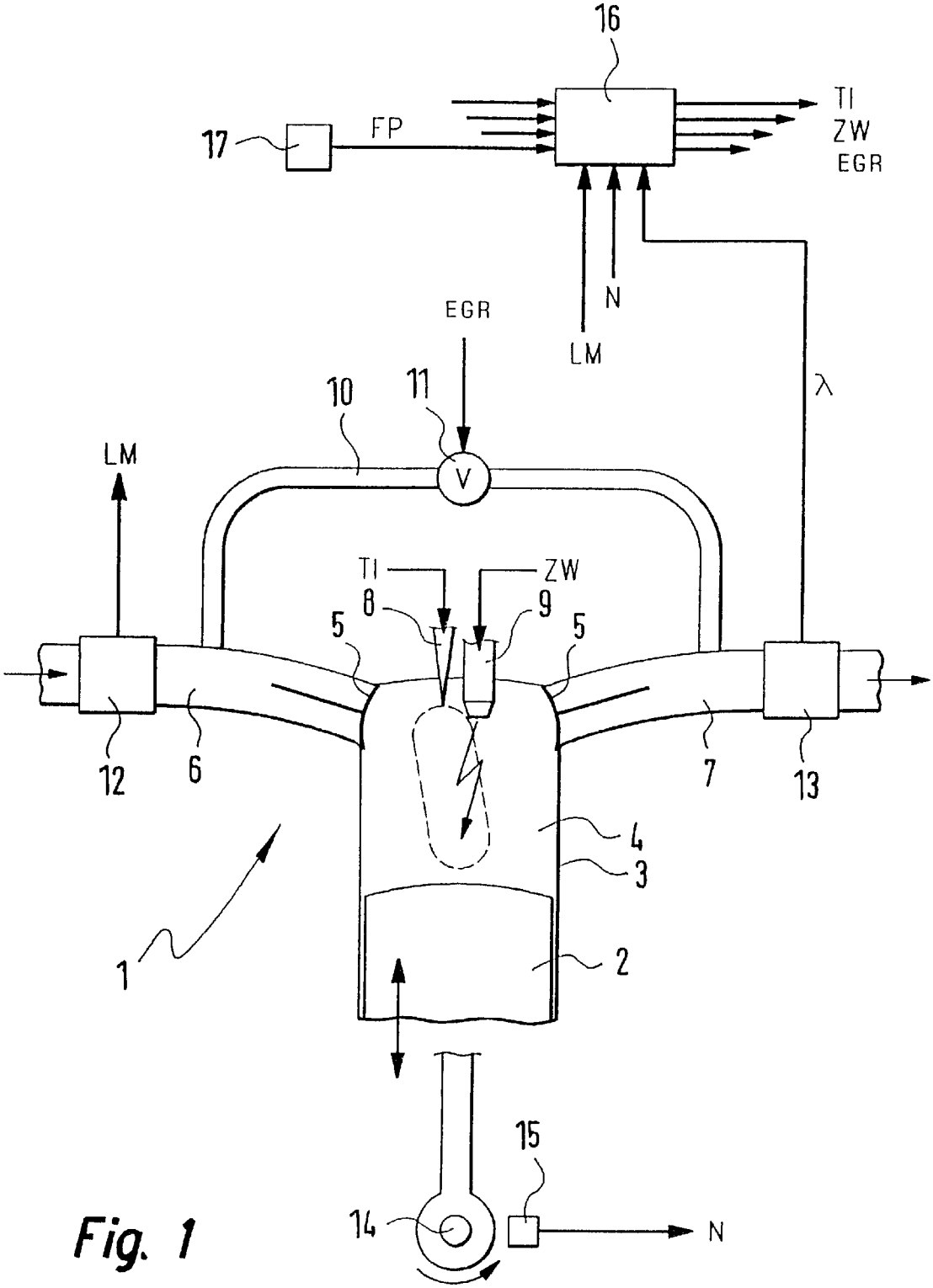
FIG. 1 shows a schematic block circuit diagram of an embodiment of an internal combustion engine of a motor vehicle in accordance with the invention.

In FIG. 1, an internal combustion engine 1 is shown wherein a piston 2 is movable back and forth in a cylinder 3. The cylinder 3 is provided with a combustion chamber 4 to which an intake manifold 6 and an exhaust-gas pipe 7 are connected via valves 5. Furthermore, an injection valve 8, which can be driven by a signal TI, and a spark plug 9, which can be driven by a signal ZW, are assigned to the combustion chamber 4. The exhaust-gas pipe 7 is connected via an exhaust-gas recirculation line 10 and an exhaust-gas recirculation valve 11 to the intake manifold 6. The exhaust-gas recirculation valve 11 can be controlled by a signal EGR.

The intake manifold 6 is provided with an air mass sensor 12 and the exhaust-gas pipe 7 is provided with a lambda sensor 13. The air mass sensor 12 measures the oxygen mass of the fresh air, which is supplied to the intake manifold 6 and generates a signal LM in dependence thereon. The lambda sensor 13 measures the oxygen content of the exhaust gas in the exhaust-gas pipe 7 and generates a signal λ in dependence thereon.

In a first operating mode, the stratified operation of the internal combustion engine 1, the fuel is injected into the combustion chamber 4 by the injection valve 8 during a compression phase caused by the piston 2 and is spatially injected into the direct vicinity of the spark plug 9 as well as, in time, directly ahead of the top dead center point of the piston 2 or ahead of the ignition time point. Then, with the aid of the spark plug 9, the fuel is ignited so that the piston 2 is now driven in the following work phase by the expansion of the ignited fuel.

In a second mode of operation, the homogeneous operation of the internal combustion engine 1, the fuel is injected into the combustion chamber 4 by the injection valve 8 during an induction phase caused by the piston 2. With the simultaneous induction of air, the injected fuel is swirled and thereby essentially uniformly distributed in the combustion chamber 4. Thereafter, the air/fuel mixture is compressed during the compression phase in order to be then ignited by the spark plug 9. The piston 2 is driven by the expansion of the ignited fuel.

In stratified operation, as also in homogeneous operation, the crankshaft 14 is set into a rotational movement by the driven piston via which finally the wheels of the motor vehicle are driven. An rpm sensor 15 is assigned to the crankshaft 14 and generates a signal N in dependence upon the rotational movement of the crankshaft 14.

The fuel is injected into the combustion chamber 4 in stratified operation and in homogeneous operation under a high pressure via the injection valve 8. For this purpose, an electric fuel pump and a high pressure pump are provided. The high pressure pump can be driven by the engine 1 or by an electric motor. The electric fuel pump generates a so-called rail pressure EKP of at least 3 bar and the high pressure pump generates a rail pressure HD up to approximately 100 bar.

The fuel mass, which is injected in stratified operation and in homogeneous operation by the injection valve 8 into the combustion chamber 4, is controlled (open loop and/or closed loop) especially with respect to a low fuel consumption and/or a low development of toxic substances. For this purpose, the control apparatus 16 is provided with a microprocessor which has a program stored in a storage medium, especially in a read-only-memory. The program is suited to carry out the above-mentioned control (closed loop and/or open loop).

Input signals are applied to the control apparatus 16 and these signals define operating variables of the engine measured by means of sensors. For example, the control apparatus 16 is connected to the air mass sensor 12, the lambda sensor 13 and the rpm sensor 15. Furthermore, the control apparatus 16 is connected to an accelerator pedal sensor 17 which generates a signal FP. The signal FP indicates the position of an accelerator pedal which can be actuated by the driver. The control apparatus 16 generates output signals with which the performance of the engine can be influenced via actuators in correspondence to the desired control (closed loop and/or open loop). For example, the control apparatus 16 is connected to the injection valve 8, the spark plug 9 and the exhaust-gas recirculation valve 11 and generates the signals TI, ZW and EGR which are necessary for their control.

Figure 2:
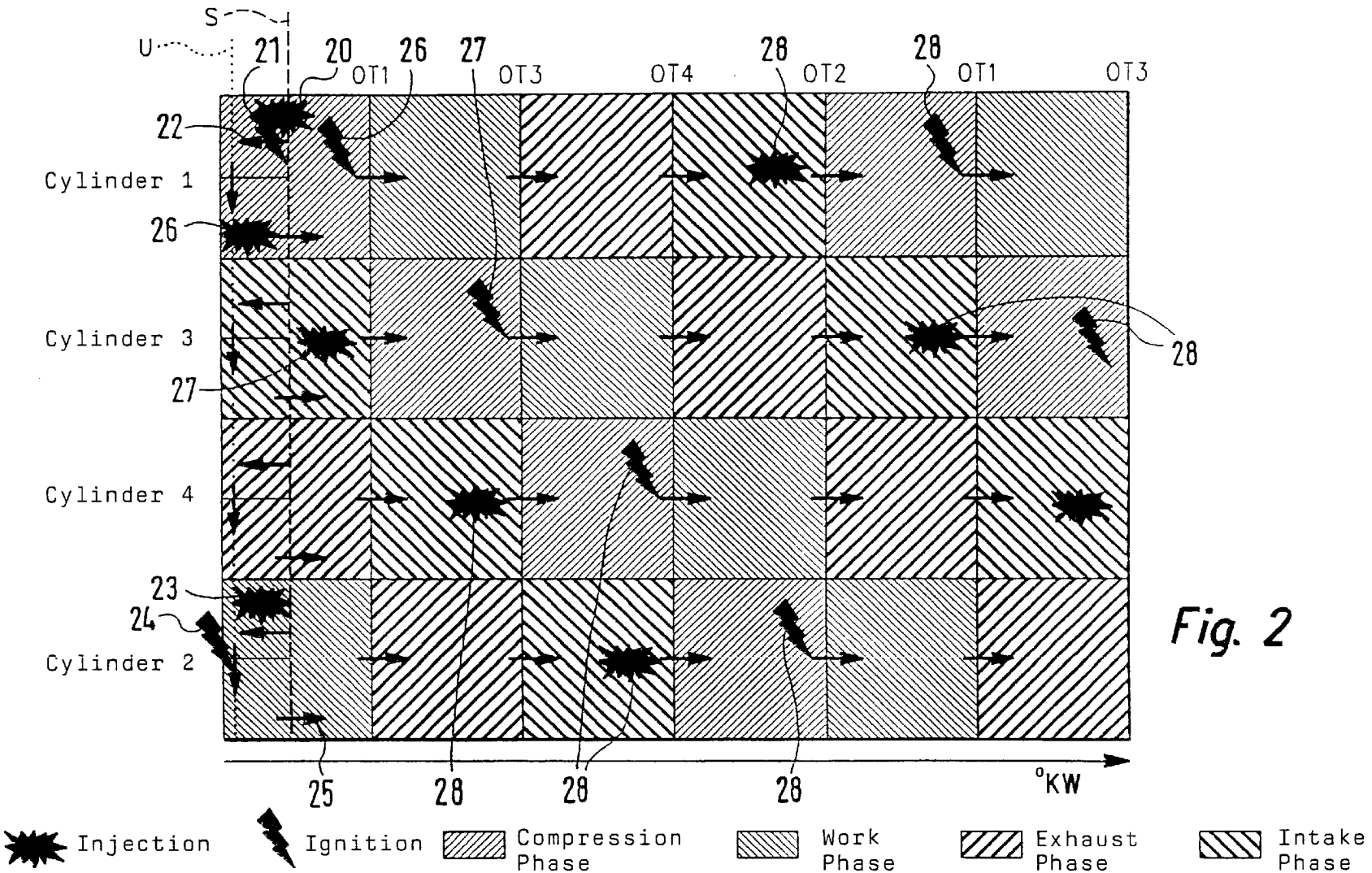
FIG. 2 shows a schematic diagram of a first embodiment of a method of the invention for starting the internal combustion engine of FIG. 1; and, FIG. 3 shows a schematic diagram of a second embodiment of a method of the invention for starting the internal combustion engine of FIG. 1.
Figure 3:
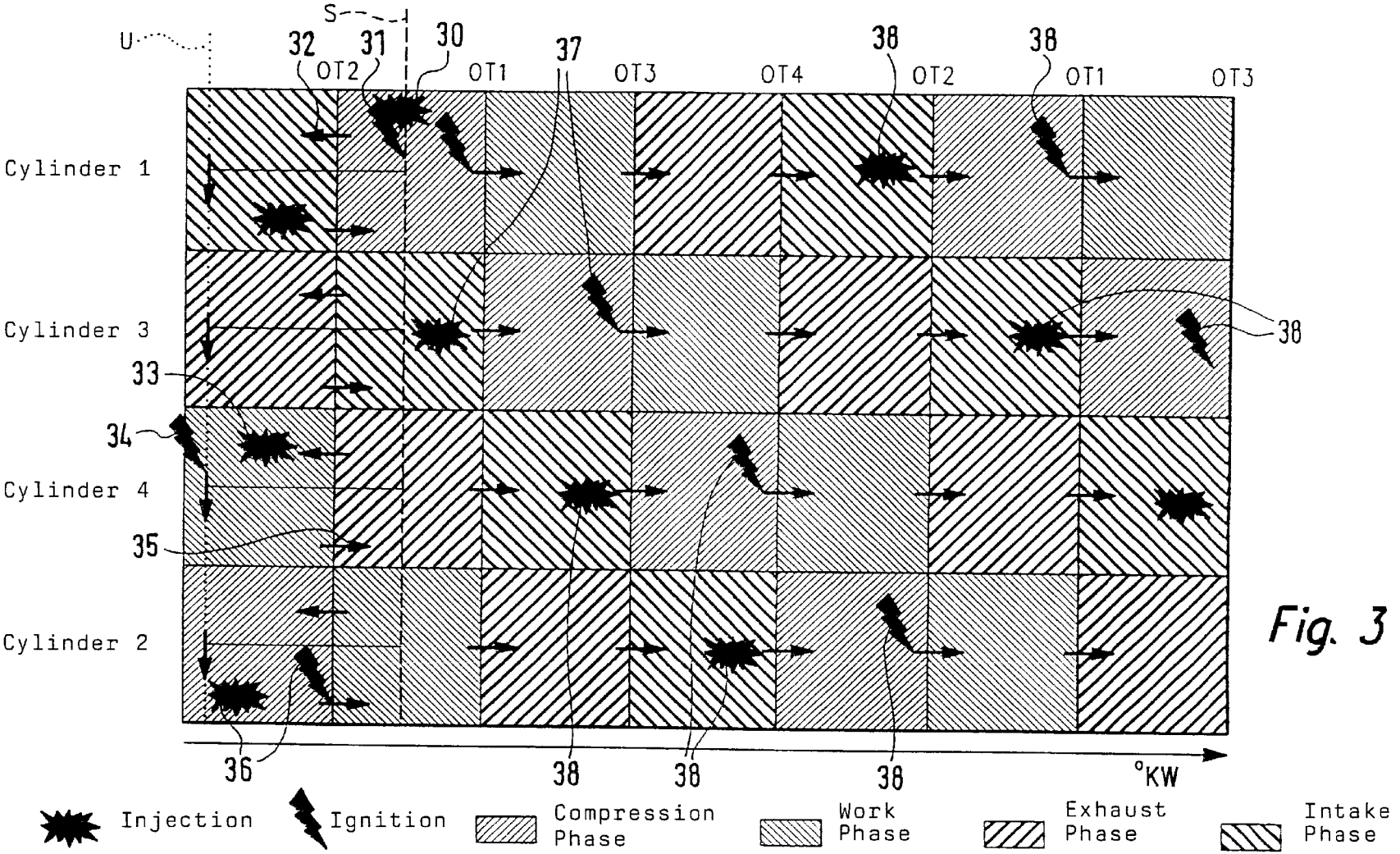

In FIGS. 2 and 3, two methods for starting the engine 1 of FIG. 1 are shown in the form of diagrams. The individual lines of the diagrams relate to the corresponding cylinder 3. The different cylinders 3 are identified by numbers. The individual columns of the diagrams relate to the respective phases or strokes in which the piston 2 of the corresponding cylinder 3 is. Each of the pistons 2 can be in an induction phase, a compression phase, a work phase or a discharge phase. The transitions between the individual phases are identified by the top dead center point OT of the pistons 2. The axis along the phases of the pistons 2 defines a rotational angle °KW of the crankshaft 14 in the forward direction. The position of the engine 1 in advance of the start is shown by the broken line S, that is, the position of the engine 1 at standstill.

No starter is necessary in the methods of FIGS. 2 and 3.

According to FIG. 2, fuel is injected into the cylinder no. 1, which, with the phantom-outline position of the engine 1, is in its compression phase, that is, at standstill of the engine 1. The fuel is then correspondingly metered in accordance with the stratified operation. This defines a first injection which is identified in FIG. 1 with the reference numeral 20.

The injection can, when the high pressure pump is mechanically driven by the engine 1, take place only with the rail pressure EKP generated by the electric fuel pump. However, if the high pressure pump is, for example, electrically driven, then the injection can take place with the rail pressure HD generated by the high pressure pump.

The injected fuel is then likewise ignited in the compression phase of the cylinder No. 1 which is identified by the reference numeral 21. This has the consequence of a first combustion in the cylinder no. 1 which causes the crankshaft 14 to be set in rotational motion.

Since the piston of the cylinder no. 1 is located ahead of its top dead center point, the crankshaft 14, however, does not move forwards but rearwards. This is shown in FIG. 1 by the arrow 22.

At this time point of the rearward movement of the crankshaft 14, the cylinder no. 2 is disposed in its work phase. With the rearward movement, the piston of the cylinder no. 2 again approaches its top dead center point. In this way, a compression pressure is built up in cylinder no. 2 which brakes the rearward movement of the crankshaft 14.

It is assumed that the first combustion is controlled (open loop and/or closed loop) so that the torque, which is generated by the first combustion in the rearward direction, is not sufficient to bring the piston of the cylinder no. 2 beyond its upper dead center point. Accordingly, the compression pressure, which builds up in cylinder no. 2, is greater than this torque acting rearwardly. This means that the piston of the cylinder no. 1 does not move beyond its rearward bottom dead center. This can, for example, be achieved by a correspondingly low dimensioned injected fuel mass for the first combustion. The consequence is that the rotational direction of the crankshaft 14 reverses before reaching the above-mentioned upper dead center into the forward direction. This reversal point is located shortly after a stroke transition and is shown in FIG. 1 by the dotted line U.

Before the piston of cylinder no. 2 reaches the reversal point U, fuel is injected into the combustion chamber of this cylinder no. 2 which is made clear in FIG. 2 by the reference numeral 23. In the reversal point U or shortly thereafter, this fuel is ignited in the cylinder no. 2 which is shown by reference numeral 24. A second combustion takes place in cylinder no. 2.

The cylinder no. 2 carries out a normal work stroke because of the ignition of the fuel in cylinder no. 2 at the reversal point U. In this way, the crankshaft 14 is accelerated in the forward direction. This is indicated in FIG. 2 by the arrow 25.

After passing through the reversal point U (that is, after the engine 1 moves in the forward direction), the cylinder no. 1 is in its normal compression phase. Fuel is again injected into cylinder no. 1 in the compression phase. This fuel can also be injected already before the reversal point U but also directly in the reversal point U or even thereafter. The fuel is injected in correspondence to the stratified operation. The ignition of the fuel takes place shortly before or at the top dead center point of cylinder no. 1. In FIG. 2, this is identified by the reference numeral 26 and defines a third combustion in cylinder no. 1.

With this injection and ignition of fuel in cylinder no. 1, the crankshaft 14 is driven further in the forward direction. It is noted that this third combustion can also be omitted, especially when there is too little air in cylinder no. 1.

Cylinder no. 3 is in its induction phase after passing through the reversal point U. Fuel is now injected into cylinder no. 3 in this induction phase which is ignited in the following compression phase of the cylinder no. 3. This is identified in FIG. 2 by reference numeral 27 and defines a fourth combustion.

The injection and ignition of fuel in cylinder no. 3 takes place in correspondence to the homogeneous operation. The internal combustion engine 1 continues to be driven in the forward direction by the resulting combustion of fuel in cylinder no. 3.

After passing through the reversal point U, fuel is injected into cylinder no. 1 and into cylinder no. 3 during the same stroke. The ignition of this fuel, however, takes place in sequential strokes of the engine 1. In this way, a high acceleration of the engine 1 and therefore starting thereof is achieved.

Thereafter, fuel is injected sequentially into the cylinders no. 4, no. 2, no. 1, no. 3, et cetera in the respective induction phases and ignited in the compression phases. This is identified in FIG. 2 by the reference numerals 28. In this way, the engine 1 is controlled (open loop and/or closed loop) in homogeneous operation with which the engine is finally accelerated to the idle rpm.

Alternatively, it is possible to execute the injections, which are carried out in homogeneous operation, also in stratified operation. This is especially possible when the rail pressure HD, which is generated by the high pressure pump, is already completely built up.

According to FIG. 3, fuel is injected into cylinder no. 1. This cylinder is in its compression phase for the dotted position of the engine 1, that is, at standstill thereof. This defines a first injection which is identified by reference numeral 30 in FIG. 3. Then, the injected fuel is likewise ignited in the compression phase of cylinder no. 1 which is identified by reference numeral 31. Since the piston of cylinder no. 1 is located ahead of its top dead center point, the crankshaft 14 does not, however, move forward and instead moves backwards. This is shown in FIG. 3 by the arrow 32.

Cylinder no. 2 is in its work phase at this time point of the rearward movement of the crankshaft 14. The piston of cylinder no. 2 again approaches its top dead center point with the rearward movement. In this way, a compression pressure is built up in cylinder no. 2 which brakes the rearward movement of the crankshaft 14. Furthermore, the piston of cylinder no. 4 is in its discharge phase.

It is assumed that the first combustion is so controlled (open loop and/or closed loop) that the torque, which is generated by the first combustion in the rearward direction, is, on the one hand, sufficient to bring the piston of cylinder no. 2 beyond its top dead center point but that this torque is, on the other hand, not sufficient to thereafter also move the piston of cylinder no. 4 beyond its top dead center point. This means that the piston of cylinder no. 1 is indeed moved beyond its rearward bottom dead center point but is not moved beyond its next rearward upper top dead center point. This can, for example, be achieved by a correspondingly dimensioned injected fuel mass into the cylinder no. 1.

The consequence of this is that the rotational direction of the crankshaft 14 does not reverse into the forward direction before reaching the top dead center point of cylinder no. 2 but only before reaching the top dead center point of cylinder no. 4. This reversal point is shown in FIG. 3 by a dotted line U and is shortly after a stroke transition. At this reversal point U, the cylinder no. 2 is in its compression phase and the cylinder no. 4 is in its work phase.

Before the piston of cylinder no. 4 reaches the reversal point U, fuel is injected into the combustion chamber of this cylinder no. 4 which is indicated in FIG. 3 by the reference numeral 33. At reversal point U, this fuel is ignited in cylinder no. 4 which is identified by reference numeral 34.

A normal work stroke is carried out by cylinder no. 4 with the ignition of the fuel therein. In this way, the crankshaft 14 is accelerated in the forward direction. This is identified in FIG. 3 with the arrow 35.

After passing through the reversal point U (that is, after the engine 1 moves into the forward direction), cylinder no. 2 is in its normal compression phase. Fuel is now injected into cylinder no. 2 in this compression phase. This fuel can already be injected ahead of the reversal point U but also directly at reversal point U or even thereafter. The fuel is injected in correspondence to the stratified operation. The ignition of the fuel takes place shortly ahead of the top dead center point of cylinder no. 2. This is identified in FIG. 1 by the reference numeral 36.

Cylinder no. 3 is in its induction phase after passing through the reversal point U. Fuel is now injected into cylinder no. 3 in this induction phase and this fuel is ignited in the following compression phase of cylinder no. 3. This is identified in FIG. 3 by reference numeral 37.

Thereafter, fuel is injected sequentially into the cylinders no. 4, no. 2, no. 1, no. 3, et cetera, respectively, in the induction phase and ignited respectively in the compression phase. This is identified in FIG. 3 by the reference numeral 38.

In the above described embodiments, a four-cylinder internal combustion engine was always assumed. However, it is likewise possible to apply the described procedure to a two-cylinder engine or a three-cylinder engine. Here, the first combustion must be carried out so that that piston which first reaches its work phase in the completed rearward movement is not moved beyond its top dead center point. Starting from this reversal point, the engine can be started in the manner described.

The described procedure for a four-cylinder internal combustion engine can be likewise applied to engines having more than four cylinders.

What is claimed is:

1. A method for starting an internal combustion engine including an engine of a motor vehicle, the engine having a piston movable in a cylinder and acting on a crankshaft to rotate the crankshaft in a forward direction of movement, the piston running through an intake phase, a compression phase, a work phase and an exhaust phase, the engine further including a system for injecting fuel directly into a combustion chamber delimited by the cylinder and the piston in one of a first operating mode during a compression phase and a second operating mode during an intake phase and, thereafter, igniting the fuel, the method comprising the step of: at standstill of the crankshaft, injecting and igniting fuel in that cylinder (no. 1) whose piston is disposed in the compression phase so that the crankshaft is rotated in a rearward direction of movement opposite to said forward direction.

2. The method of claim 1, wherein the injection and the ignition is carried out so that said piston (cylinder no. 1) does not move beyond its rearward lower dead center point, but that the movement of the crankshaft reverses there into said forward direction of movement (reversal point U).

3. The method of claim 2, wherein fuel is injected into that cylinder (no. 2) whose piston is disposed at the reversal point (U) in the work phase and is ignited at a time point corresponding to one of the reversal point (U) and shortly after the reversal point (U).

4. The method of claim 2, wherein fuel is injected into that cylinder (no. 1) whose piston is disposed at the reversal point in the compression phase and is ignited at a time point corresponding to one of shortly ahead of top dead center (OT1) and at top dead center (OT1) of this piston.

5. The method of claim 1, wherein the injection and the ignition are carried out so that the piston (cylinder no. 1) moves beyond its rearward bottom dead center point but not over its next-following rearward top dead center point, but that the movement of the crankshaft reverses there into a forward movement (reversal point U).

6. The method of claim 5, wherein fuel is injected into that cylinder (no. 4) whose piston is disposed at the reversal point (U) in the work phase and is ignited at a time point corresponding to one of the reversal point (U) and shortly after the reversal point (U).

7. The method of claim 5, wherein fuel is injected into that cylinder (no. 2) whose piston is disposed at the reversal point in the compression phase and is ignited at a time point corresponding to one of shortly ahead of top dead center (OT2) and at the top dead center point (OT2) of this piston.

8. The method of claim 4, wherein fuel is injected into that cylinder (no. 3) whose piston is disposed at the reversal point in the intake phase and is ignited in the next-following compression phase.

9. The method of claim 8, wherein, thereafter, fuel is injected into the cylinder in the normal sequence and ignited.

10. The method of claim 9, wherein the fuel is injected during one of homogeneous operation and stratified operation and is ignited.

11. An internal combustion engine including an engine for a motor vehicle, the engine comprising:

a piston movable in a cylinder and operating on a crankshaft to rotate the crankshaft in a forward direction of movement;

the piston running through an intake phase, a compression phase, a work phase and an exhaust phase;

a control apparatus with which the fuel is injected directly into a combustion chamber delimited by the cylinder and the piston in a first operating mode during a compression phase or in a second operating mode during an intake phase; and, the control apparatus being so configured that, for starting the engine, at standstill of the crankshaft, fuel is injected into that cylinder (no. 1) whose piston is disposed in the compression phase and is ignited so that the crankshaft is rotated in a rearward direction of movement opposite to said forward direction.

* * * * *